United States Patent [19]

Gray et al.

[11] Patent Number: 4,577,667

[45] Date of Patent: Mar. 25, 1986

[54] LOG SPLITTING DEVICE

[75] Inventors: Kevin Gray, Manti, Utah; Frederic A. Johnson, 235 E. 100 North, Manti, Utah 84642

[73] Assignee: Frederic A. Johnson, Manti, Utah

[21] Appl. No.: 650,098

[22] Filed: Sep. 13, 1984

[51] Int. Cl.[4] ..... B27L 7/00

[52] U.S. Cl. ..... 144/193 C; 144/193 R

[58] Field of Search ..... 144/193 R, 193 C, 193 D, 144/366

[56] References Cited

U.S. PATENT DOCUMENTS

| | | | |
|---|---|---|---|
| 3,050,095 | 8/1962 | Prather | 144/193 C |
| 3,519,234 | 7/1970 | Matson | 144/193 C |
| 4,280,540 | 7/1981 | Mencham | 144/193 C |
| 4,308,903 | 1/1982 | Alloway | 144/193 D |
| 4,350,192 | 9/1982 | Dent | 144/193 C |
| 4,379,475 | 4/1983 | Nokes | 144/193 C |
| 4,429,727 | 2/1984 | Wilson | 144/193 C |
| 4,431,040 | 2/1984 | Friedrich et al. | 144/193 C |

*Primary Examiner*—W. D. Bray

*Attorney, Agent, or Firm*—Calvin E. Thorpe; Vaughn W. North; M. Wayne Western

[57] ABSTRACT

A log splitting apparatus comprising an elongated driving shaft, a wedge shaped splitting tip attached at one end of the driving shaft and an elongated driver sleeve in which the driving shaft is telescopically mounted. The driving sleeve includes a catch coupled through the sleeve wall and adapted for releasable engagement with respect to the driver shaft. The catch is biased to a nonengaging position to allow the driver shaft to freely move within the encasement except when the catch is depressed by the user. When depressed, the catch locks the shaft in an intermediate position to enable the user to transport the apparatus in a vertical orientation.

5 Claims, 3 Drawing Figures

LOG SPLITTING DEVICE

BACKGROUND OF THE INVENTION

1. Field of the Invention

This invention pertains to a log splitting device having an outer driver sleeve which impacts against a telescopically housed inner driving shaft within the sleeve, which sleeve also serves as a guide channel to maintain the driver sleeve in common axial orientation with the impacted shaft as the sleeve is raised and lowered for impact.

2. Prior Art

Numerous wedge shaped devices have been developed as log splitting tools. The telescopic driver, sometimes referred to as a pipe-driver, is one such driver which is particularly convenient for a single user. It consists of an elongated driving shaft which has a wedge-shaped splitting tip mounted at its bottom end. This shaft is encased within an elongated driver sleeve which has a driver cap at the top for impacting the top end of the shaft. It is used by placing the splitting tip on the log, sliding the sleeve upward with respect to the shaft and slamming the sleeve downward to impact the cap of the sleeve on the top of the shaft. In this manner the momentum of the heavy sleeve is transferred to the shaft, forcing the wedge into the wood. The wood is split as the wedge is driven deeper into the wood.

The convenience of the driver arises from the fact that it is suitable for a single individual to handle. For example, use of a separate wedge and sledge hammer often requires two individuals in order to develop an efficient operation—one to hold the wedge while the other mans the hammer. The telescopic driver automatically maintains coaxial orientation between the driver and wedge and thereby eliminates the need for the second individual. Such prior art is illustrated in the following patents:

U.S. Pat. Nos. 4,350,192, 4,327,787, 4,101,088, and 3,519,234.

The -192 patent of Dent is typical of the previously described telescopic drivers. It includes a ring attached at the base of the shaft just above the wedge. A pair of handles are mounted midway at the sides of the sleeve to facilitate the repeated driving action as well as to enhance its portability. The device is usually carried and positioned by grasping the handle on the sleeve with one hand and by holding on to the ring or shaft with the other hand. This is necessary to keep the shaft from falling from its recessed position within the sleeve. Accordingly, such a tool requires the use of both hands.

In order to free one hand during carriage, some splitting tools have incorporated a retaining pin or other device for holding the shaft in the recessed position when the tool is not in use. Representative examples are illustrated in the following patents:

U.S. Pat. Nos. 4,379,475, 4,405,005, 4,431,040, 3,050,095, and 4,280,540.

The -040 patent shows the use of a retaining pin for locking the shaft inside the sleeve when the tool is not being used.

The top of the shaft includes a flange or lip whose movement is blocked by the inserted pin. When the pin is removed, however, the shaft and flange are free to move within the sleeve. U.S. Pat. Nos. 4,379,475 and 4,405,005 illustrate the use of a cord or chain attached at respective ends to the sleeve and shaft to prevent the shaft from falling free of the sleeve.

Although prior art devices have provided a solution for carrying the splitting tool, a significant problem exists with respect to such devices during actual use. When the retaining pin is removed prior to use, the shaft is free to move. Obviously this is necessary if the device is to function properly with repeated impacts at the log to be split. However, when the wedge breaks through the log, the device will typically be moved to the next log. When lifted with the pin removed, the shaft simply remains at its ground position until the top of the shaft encounters a blocking flange at the base of the sleeve. It can then be raised by the sleeve to a new location. Alternatively, the user grasps the shaft with one hand and the sleeve with the other and moves both parts. Although this inconvenience can be tolerated for a short duration, repeated use would be greatly facilitated by a splitting tool specifically adapted for short movements between logs without the need to reach down and grasp the shaft and sleeve together.

OBJECTS AND SUMMARY OF THE INVENTION

It is therefore an object of this invention to provide a log splitting device which enables the user to lift the device in its vertical orientation during use without the need for grasping the shaft to prevent it from falling with respect to the sleeve.

It is an additional object of this invention to provide a log splitting device which enables the user to hold the device with two hands on the sleeve and at the same time control free movement of the shaft.

It is a still further object of this invention to provide a log splitting device which has limited range of movement of the shaft driver to prevent it from inadvertently falling free of the sleeve.

These and other objects are realized in a log splitting device comprising an elongated driving shaft, a wedge-shaped splitting tip attached at a bottom end of the shaft. The shaft is telescopically enclosed at an upper portion thereof within a driving sleeve which has a driver cap at the top adapted for impacting at the top of the shaft. The device includes a catch coupled through the sleeve wall which engages a portion of the upper shaft to lock the shaft at a fixed position with respect to the sleeve when the catch is depressed. The catch is biased to a nonengaging position which enables free movement of the shaft within the sleeve. The catch is located near handles attached to the sleeve to facilitate easy reach of the catch while holding the device at the handles.

Other objects and features of the present invention will be apparent to one skilled in the art based upon the following detailed description taken in combination with the drawings which include:

FIG. 1 which depicts a perspective view of a log splitting device constructed in accordance with the subject invention;

FIG. 2 showing a cross-sectional view of the device shown in FIG. 1, taken along the lines 2—2;

FIG. 3 which provides a cross-sectional view (except for the pin and mounted spring) taken along the lines 3—3 of FIG. 1.

DETAILED DESCRIPTION OF THE INVENTION

Figure 1:
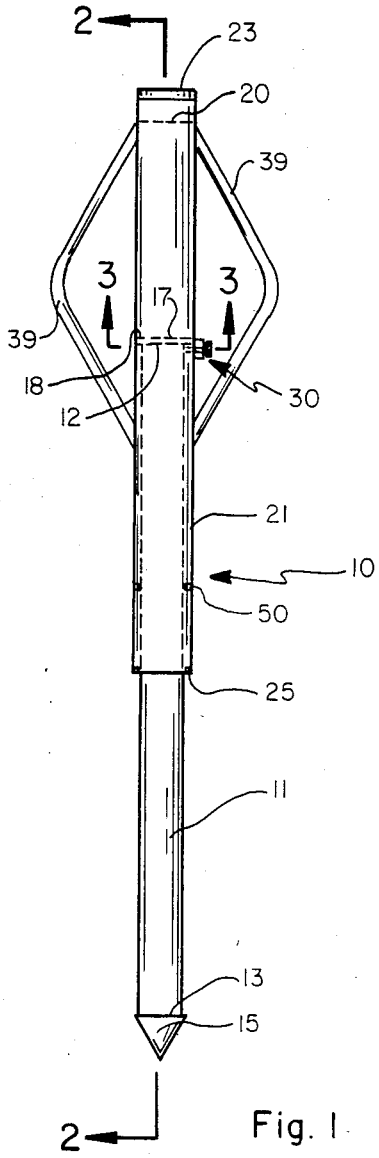

Referring Now to the Drawings:

A log splitting device 10 constructed in accordance with the present invention includes an elongated driving shaft 11 which has a top end 12 and a bottom end 13. This shaft 11 may be tubular in construction as shown in the figures, or it may be solid where increased weight is desirable. The embodiment illustrated comprises a steel pipe.

A wedge shaped splitting tip 15 is attached to the bottom 13 of the driving shaft 11. Typically, this splitting wedge 15 will be solid steel and will have a width at its point of attachment equal to or greater than the outer diameter of the pipe or shaft 11.

An impact plate 17 is attached to the top of the shaft 12 and provides two primary functions. The top surface of the impact plate 17 is geometrically configured to match the interior contacting surface of an impact cap 20 to be discussed hereafter. Impact energy is thereby dissipated over the respective contacting surfaces to minimize wear of the contacting metal. The second function of the impact plate 17 is to provide a flange edge 18 which represents that part of the plate which extends beyond the outer perimeter (represented by $R_1$) of the shaft 11. The purpose of this flange 18 is discussed hereafter.

The construction of the shaft 11, splitting tip 15 and impact plate 17 is represented by separate components which are welded together to form a single, unitary structure. It will be obvious to one skilled in the art that such construction must be very sturdy to meet the stresses arising as the shaft is driven into a log to be split.

This driving shaft 11 is housed within an elongated driver sleeve 21. This driver sleeve 21 comprises a steel pipe having an inner radius $R_3$ slightly larger than the outer radius $R_2$ of the impacting plate 17. This permits the shaft 11 and attached impact plate 17 to move freely along the longitudinal axis Y of the shaft 11 and sleeve 21. It can therefore be seen that the driver sleeve 21 is formed by an enclosing sleeve wall slightly mounted around an upper part of the driving shaft 11. The sleeve is capped 23 on its top end and open at the bottom end to to allow the shaft 11 to be telescopically encased within the sleeve. The top of the sleeve may also include an impact cap 20 specifically designed to enhance the transfer of impact force to the shaft at the impact plate 17. It will be apparent that the nature of use for the present device requires that the shaft 11 exceed the length from the base of the impact cap 20 to the end of the sleeve.

The bottom end of the sleeve 21 includes a retaining flange 25 which projects inward from the lower end of the sleeve such that it intercepts the movement path 26 of the perimeter of the impact plate 17. Accordingly, this retaining flange 25 prevents inadvertent release of the shaft 11 from its recessed position within the sleeve 21. As used herein, flange path refers to the path traveled by the extending rim 18 around the perimeter of the impact plate 17. This path starts at the fully recessed position of the shaft 11 wherein the impact cap 20 and impact plate 17 are in contact. The flange path 26 terminates at the other end of the sleeve wherein the path is intercepted by the retaining flange 25.

Figure 2:
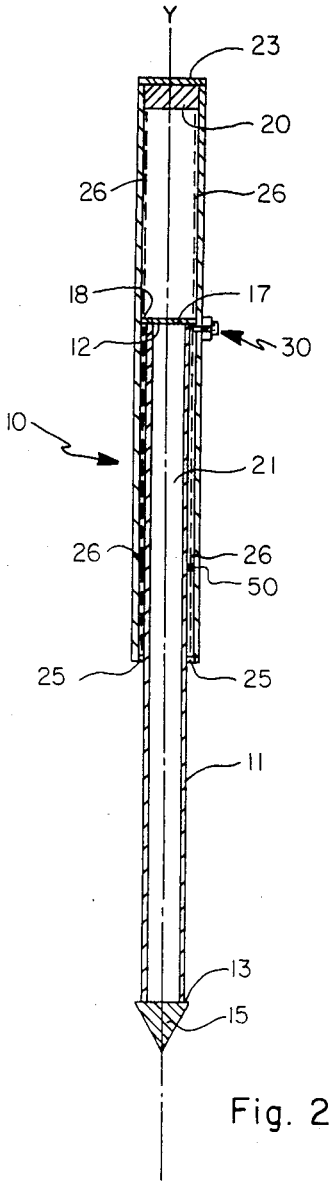

A primary feature of the present invention is a catch 30 which enables the user of the device to lock the shaft 11 at an intermediate position between the impact cap 20 and retaining flange 25. Typically, this position will be in the upper half of the sleeve because the device is easier to move in a vertical position when the shaft 11 is substantially recessed within the sleeve casement. As shown in FIG. 2 and detailed in FIG. 3, this catch is coupled through the sleeve wall which is adapted for releasable engagement with an upper portion of the driver shaft. As will be noted from the figures, this catch is operable from the exterior of the sleeve 21 so that the user can lock the driver in place without changing the vertical orientation of the device and without the need to physically grasp the exposed portion of the shaft 11 outside the sleeve 21.

Figure 3:
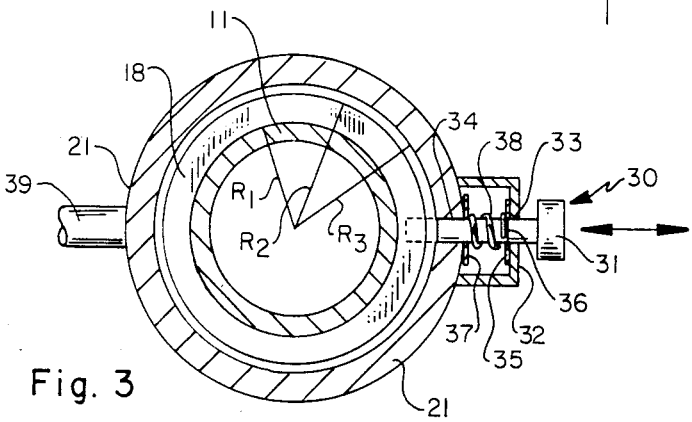

Referring to the enlarged section shown in FIG. 3, the catch 30 includes a detent pin 31 slidably disposed in a support housing 32 which comprises a shield member attached to the exterior of the sleeve 21 and being operable to maintain the detent pin 31 in proper position for depression by the user. Correct orientation of the detent pin 31 is maintained by its fixed position within the two (2) holes 33 and 34. The outermost position of the detent pin is limited by a retaining lock-washer 35 which is journalled in a slot 36 located in the stem of the detent pin. A second washer 37 is positioned around the detent pin and against the exterior surface of the sleeve 21. A spring 38 is positioned around the detent pin between the respective washers 36 and 37 to bias the detent pin in the nonengaging position with the pin fully extended away from the sleeve enclosure. While in this nonengaging position, the sleeve is free to traverse the flange path 26 as would occur during actual operation of the log splitting device.

When the user wishes to restrain the shaft 11 in a fixed position within the sleeve, the detent pin 31 is depressed, causing the interior end of the pin to intercept the flange path 26. As the device is raised from ground level, the shaft slides into engagement with the detent pin 31 and the user is then free to move the device in its vertical orientation to a new location. When the user is prepared to again operate the log splitting device, the pin is released and automatically returns to its nonengaging position.

A pair of handles 39 are attached at the sides of the sleeve at a convenient height. Ideally, the handles should be in close proximity to the catch 30 so that the user need not free his hands from the handle in order to depress the detent pin 31 with his thumb. The user is thereby enabled to control the position of the shaft and its movement with respect to the sleeve without releasing the handles 39.

The advantages of this structure become most apparent in the context of a typical log splitting session. An example of the method of operation of the subect device in this context is set forth as follows:

1. A cut segment of log is placed on end with an exposed cut-face of the log facing upward.
2. The user grasps the handles 39 with the shaft 11 in a recessed position within the sleeve 21. He then depresses the detent pin 31 into the flange path 26 and raises the devices until the shaft 11 slides into engagement with the detent pin at flange 18 of the impact plate 17.
3. When the shaft is engaged at the detent pin, the device is raised vertically over the exposed face of the log and the splitting tip 15 is positioned at the log's center or such other place as may be desired. The user than releases the pin and raises the sleeve, allowing the shaft 11 to slide downward with respect to the sleeve.
4. The log is repeatedly impacted until split. The user then depresses the detent pin 31 and raises the device to a new position at the log face for splitting off additional segments of the wood.

Application of this method enables the user to repeatedly break away segments of a log without having to grasp the shaft 11 or free his hands from the handles 39. The advantages of this method include greatly increased efficiency in time and energy. Because the detent pin catches at the flange 18 of the impact plate 17, little effort is required to maintain the shaft 11 in its locked position, the weight of the shaft being supported at the detent pin.

An additional flange 50 may be welded to the exterior surface of the driving shaft 11 to further control its movement. This flange 50 is positioned at a mid-section of the shaft and projects outward beyond the inner perimeter of the flange 25 located at the bottom of the sleeve 21. This second flange 50 prevents the upper part of the shaft from sliding free from the sleeve as it is raised. Otherwise, the shaft would slide to the end of the sleeve until the first flange 25 is contacted by the extending portion 18 of the impact plate 17. Ideally, the distance between the impact plate 17 and the second flange 50 is greater than the distance from the top of the sleeve 20 to the catch means 30.

It will be apparent to those skilled in the art that numerous other embodiments of a catch means can be developed in accordance with the general contents of the invention. For example, a friction pad may be used in place of the flange 18 as a locking device to hold the shaft in its position. This structure has a disadvantage in that it requires constant pressure on the part of the user to maintain this locked position. In addition, other catch means can be developed which are automatically operated, as opposed to manually operated, by electronic or magnetic switching means. Accordingly, it is to be understood that the disclosed embodiment is not to be considered as limiting the scope of the invention from the definition of invention set forth in the following claims.

I claim:

1. A log splitting apparatus comprising:

an elongated driving shaft having top and bottom ends;

a wedge-shaped slitting tip attached to the bottom end of the shaft, an elongated driver sleeve formed by an enclosing sleeve wall slidably mounted around an upper part of the driving shaft and having an open bottom end and a closed top end, and having a lengvth less that that of the shaft, said top end comprising a driver cap adapted for impact at the top end of the driving shaft;

said driver sleeve further including catch means coupled through the sleeve wall and operable with respect to the driving shaft for providing releasable engagement at an enclosed portion of the upper end of the driving shaft and being operable to lock the driving shaft in a fixed position when the catch means is depressed by a user and the shaft is in a substantially recessed position within the sleeve, said catch means including means for biasing to a nonengaging position to allow the driving shaft to freely move within the driving encasement except when the catch means is depressed to thereby retain the shaft in a fixed position.

2. A tool as defined in claim 1 wherein the top end of the driving shaft includes a flange member freely moveable with the shaft along a flange path contained within the sleeve, said catch means comprising a detent pin mounted through the sleeve wall and depressable into the flange path, said pin being otherwise biased to the nonengaging position.

3. A tool as defined in claim 2 wherein the biasing means includes a spring mounted around the detent pin in tension between the sleeve wall and a shoulder portion of the pin to thereby bias the pin in the nonengaging position.

4. A tool as defined in claim 1 further comprising a flange projecting inward from the lower end of the sleeve and intercepting the flange path of the shaft to thereby block inadvertant release of the shaft from a recessed position within the sleeve.

5. A tool as defined in claim 2, further comprising a second shaft flange positioned around a midsection of the shaft and extending outward beyond the inner perimeter of the flange located at the bottom of the sleeve and operable as a stop to prevent the shaft from sliding free from the sleeve and into contact with the first flange and the top of the shaft.

* * * * *

UNITED STATES PATENT AND TRADEMARK OFFICE

CERTIFICATE OF CORRECTION

PATENT NO. : 4,577,667

DATED : March 25, 1986

INVENTOR(S) : Gray, Kevin; Manti, Utah; and Johnson, Frederic A.; Manti, Utah

It is certified that error appears in the above-identified patent and that said Letters Patent is hereby corrected as shown below:

Column 5, line 44, delete "slitting" and insert --splitting--.

Signed and Sealed this

Twenty-third Day of December, 1986

*Attest:*

DONALD J. QUIGG

*Attesting Officer* *Commissioner of Patents and Trademarks*